US005622909A

United States Patent [19]

Furuya et al.

[11] Patent Number: 5,622,909

[45] **Date of Patent: *Apr. 22, 1997**

[54] THERMOSENSITIVE RECORDING MATERIALS

[75] Inventors: Hiromi Furuya, Shimizu-machi; Yasutomo Mori, Numazu; Keishi Taniguchi, Susono; Takeshi Yuyama, Oyama-machi, all of Japan

[73] Assignee: Ricoh Company, Ltd., Tokyo, Japan

[ * ] Notice: The term of this patent shall not extend beyond the expiration date of Pat. No. 5,447,900.

[21] Appl. No.: 441,435

[22] Filed: May 15, 1995

[30] Foreign Application Priority Data

May 17, 1994 [JP] Japan ..... 6-127055

[51] Int. Cl.[6] ..... B41M 5/155

[52] U.S. Cl. ..... 503/216; 503/200; 503/207; 503/226

[58] Field of Search ..... 427/150–152; 503/200, 216, 226, 207

[56] References Cited

U.S. PATENT DOCUMENTS

| | | | |
|---|---|---|---|
| 4,978,709 | 12/1990 | Taniguchi et al. | 524/606 |
| 4,983,446 | 1/1991 | Taniguchi et al. | 428/216 |
| 5,306,687 | 4/1994 | Furuya et al. | 503/207 |
| 5,328,754 | 7/1994 | Yuyama et al. | 428/212 |
| 5,395,676 | 3/1995 | Taka et al. | 428/195 |
| 5,409,881 | 4/1995 | Mori et al. | 503/207 |
| 5,447,900 | 9/1995 | Suzaki et al. | 503/207 |

FOREIGN PATENT DOCUMENTS

| | | |
|---|---|---|
| 70-14039 | 5/1967 | Japan . |
| 43-4160 | 2/1968 | Japan . |
| 48-27736 | 4/1973 | Japan . |
| 58-82788 | 11/1981 | Japan . |
| 60-13853 | 7/1983 | Japan . |
| 61-47292 | 8/1984 | Japan . |
| 62-169681 | 7/1987 | Japan . |

*Primary Examiner*—B. Hamilton Hess
*Attorney, Agent, or Firm*—Oblon, Spivak, McClelland, Maier & Neustadt, P.C.

[57] ABSTRACT

A thermosensitive recording material of this invention has a support, on which a thermosensitive color developing layer mainly composed of a leuco dye and a color developer which is contacted with the leuco dye while heating to develop a color and a protective layer mainly composed of polyvinyl alcohol together with either aziridine compound or dimethylolurea are successively provided, the color developer being at least one of phthalic acid derivatives represented by the following general formula (I):

(I)

wherein $R_1$, X, Y and 1 are as defined in above.

The thermosensitive recording material of this invention is excellent in sensitivity and density of the color development and has the high storage stability of the recorded images. Accordingly, the thermosensitive recording material of this invention is very useful.

The selected inorganic filler may be incorporated in the thermosensitive color developing layer and/or the protective layer.

2 Claims, No Drawings

THERMOSENSITIVE RECORDING MATERIALS

FIELD OF THE INVENTION

This invention relates to a recording material. More specifically, it relates to a thermosenstive recording material excellent in storage stability of recorded images.

BACKGROUND OF THE INVENTION

Various recording materials employing a coloring reaction between electron-donating dyes (leuco dyes) which have no or pale colors and color developers which are contacted with the dyes to develop colors via heat or pressure have been proposed.

Especially, thermosensitive recording material which is one group of the recording materials are disclosed in JP-B-68004160, JP-B-70014039 and JP-A-48027736. The recording process using the thermosensitive recording material is advantageous in that troublesome operations including a development and a fixation can be omitted, that it can be conducted using a relatively simple device for a short period, that a small noise is produced and that its cost is cheap. Owing to the above advantages, the thermosensitive materials have been used as the recording materials for a computer, a facsimile, a ticket vending machine, a label printer and a recorder.

In the thermosensitive material, a color former comprising a leuco dye having a lactone, lactam or spiropyran ring which is colorless or pale and a color developer comprising an organic acid or a phenolic substance are usually used. The thermosensitive material comprising the leuco dye and the color developer is preferably used because the resultant image has a high density and its background has a high whiteness.

With the increase in demands for the thermosensitive recording processes, it is strongly requested to improve storage stabilities of the recorded images to chemicals, light and heat. In this connection, the development of the thermosensitive recording materials have been strongly desired.

In order to improve the storage stability of the recorded images, various color developers have been proposed. JP-A-58082788 and JP-A-60013852 disclose phenolsulfone compounds. JP-A-61047282 and JP-A-62169681 disclose benzoic acid metal salts and substituted salicylic acid compounds, respectively. However, the thermosensitive recording material using the above compound as the color developer is not satisfactory because the recorded images have poor resistances to oils and plasticizers.

Accordingly, an aspect of this invention is to provide the thermosensitive recording material which is excellent in storage stability due to the high resistances of the recorded images to oils and plasticizers and which is excellent in matchability with a thermal head.

The provision of a new color developer suitable for the above thermosensitive recording material is other aspect of this invention.

SUMMARY OF THE INVENTION

The thermosensitive recording material provided according to this invention comprises a support, on which a thermosensitive color developing layer is provided, the thermosensitive color developing layer being mainly composed of a leuco dye and a color developer which is contacted with the leuco dye while heating to develop a color, the color developer being at least one of phthalic acid derivatives represented by the following general formula (I), and a protective layer mainly composed of polyvinyl alcohol together with either aziridine compound or dimethylolurea being provided on the thermosensitive color developing layer.

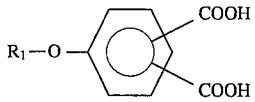

(I)

In the above formula (I), $R_1$ is a straight or branched, saturated or unsaturated hydrocarbon group, a straight hydrocarbon group which may have a hydroxy group or a ether or carbonyl linkage, an aryl group which may be substituted,

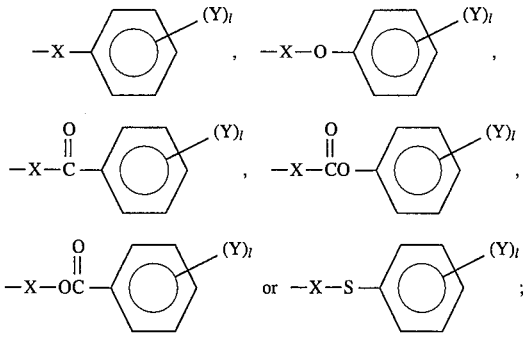

X is a saturated or unsaturated bivalent hydrocarbon group;

Y is a lower alkyl or alkoxy group, a nitro group or a halogen atom; and l is 0 to 5.

In the preferred embodiment of this invention, at least one inorganic filler selected from silicon dioxide, aluminum hydroxide, talc and kaolin may be incorporated in the thermosensitive color developing layer and/or the protective layer of this invention.

By using at least one of the phthalic acid derivatives represented by the general formula (I) as the color developer, the thermosensitive recording material of this invention gives the high storage stability to the recorded images. And, by providing the protective layer mainly composed of polyvinyl alcohol together with either aziridine compound or dimethylolurea on the thermosensitive color developing layer, the thermosensitive recording material of this invention gives further improvement in water resistance to the recorded images and excellent long storage stability to the plasticizers and oils to the recorded images.

DETAILED DESCRIPTION OF THE INVENTION

The phthalic acid derivatives represented by the general formula (I) or its mixture is used as the color developer in this invention. Typical phthalic acid derivatives represented by the general formula (I) include, but not limited to, the following compounds Nos. I-1 to I-34.

| Compound No. | Structure |
|---|---|
| I-1 | 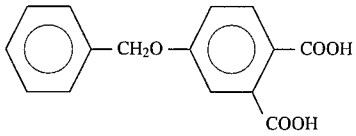 |
| I-2 | 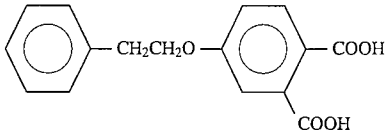 |
| I-3 | 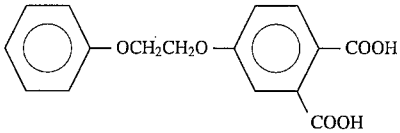 |
| I-4 | 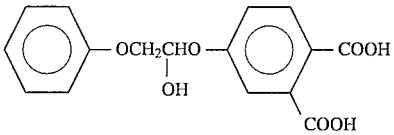 |
| I-5 | 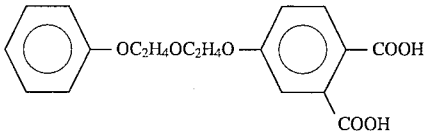 |
| I-6 | 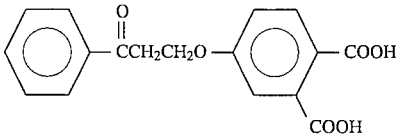 |
| I-7 | 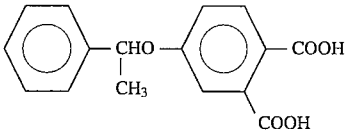 |
| I-8 | 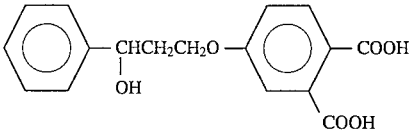 |
| I-9 | 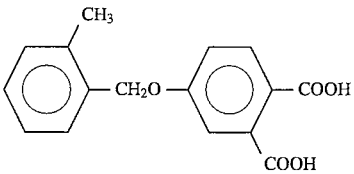 |
| I-10 | 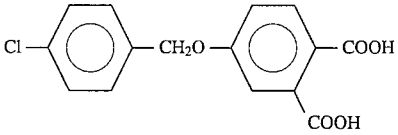 |
-continued
| Compound No. | Structure |
|---|---|
| I-11 | 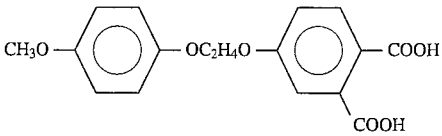 |
| I-12 | 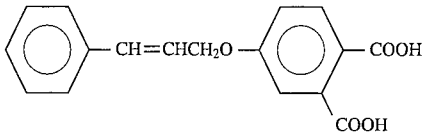 |
| I-13 | 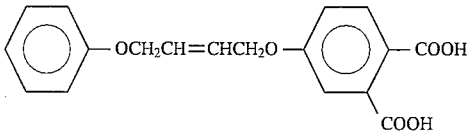 |
| I-14 | 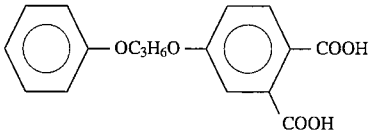 |
| I-15 | 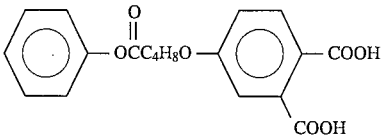 |
| I-16 | 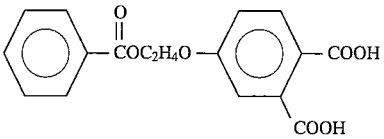 |
| I-17 | 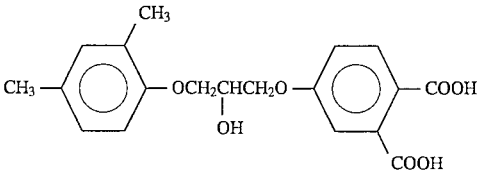 |
| I-18 | 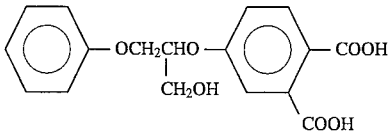 |
| I-19 | 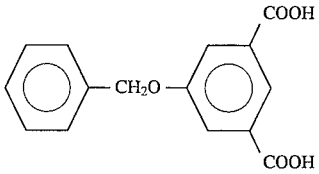 |
| I-20 | 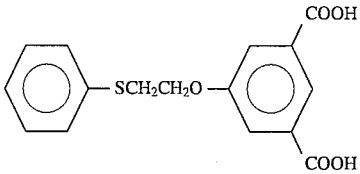 |

-continued

| Compound No. | Structure |
|---|---|
| I-21 | 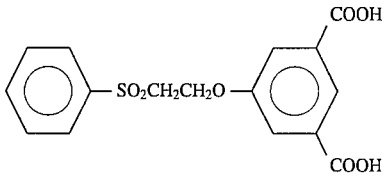 |
| I-22 | 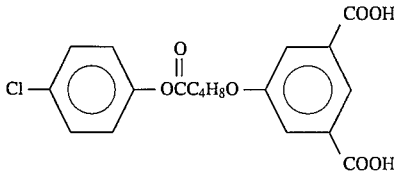 |
| I-23 | 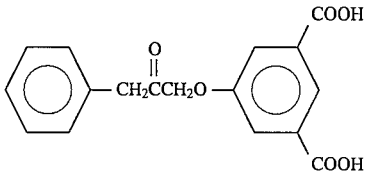 |
| I-24 | 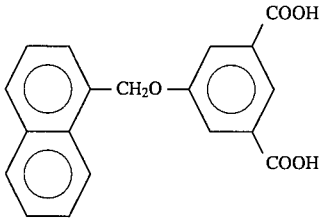 |
| I-25 | 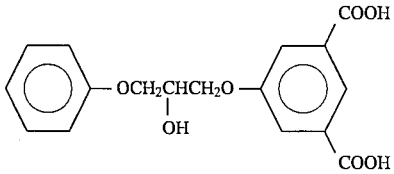 |
| I-26 | 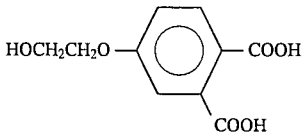 |
| I-27 | 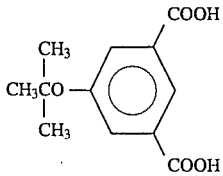 |
| I-28 | 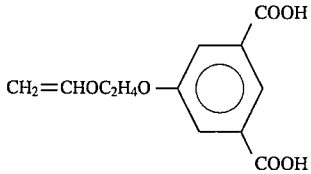 |

-continued

| Compound No. | Structure |
|---|---|
| I-29 | 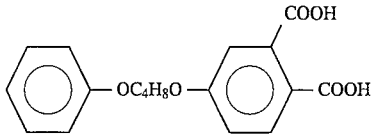 |
| I-30 | 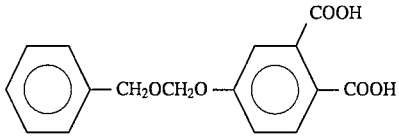 |
| I-31 | 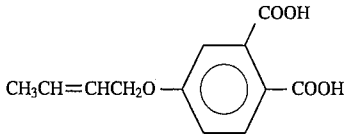 |
| I-32 | 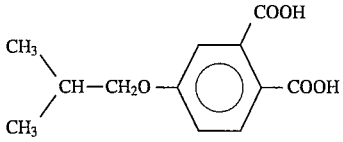 |
| I-33 | 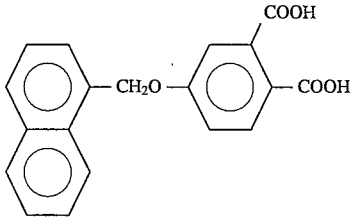 |
| I-34 | 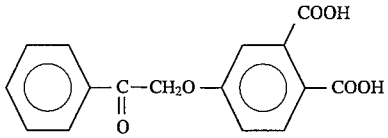 |

If necessary, other electron-accepting compounds such as phenol compounds, thiophenol compounds, thiourea derivatives, organic acids and their metal salts may be used in combination with the above phthalic acid derivative. Usable electron-accepting compounds include, but not limited to, 4,4'-isopropylidene diphenol, 4,4'-isopropylidene bis-o-methylphenol, 4,4'-sec-butylidene bisphenol, 4,4'-isopropylidene bis(2-tert-butylphenol), zinc p-nitrobenzoate, 1,3,5-tris(4-tert-butyl-3-hydroxy-2,6-dimethylbenzyl isocyanuric acid, 2,2-(3,4-dihydroxyphenyl)propane, bis(4-hydroxy-3-methylphenyl)sulfide, 4-(β-(p-methoxyphenoxy)ethoxy)salicylic acid, 1,7-bis(4-hydroxyphenylthio)-3,5-dioxaheptane, 1,5-bis (4-hydroxyphenylthio)-3-oxapentane, monopotassium salt of monobenzyl phthalate, 4,4'-cyclohexylidene diphenol, 4,4-isopropylidene bis(2-chlorophenol), 2,2 -methylene bis(4-methyl-6-tert-butylphenol), 4,4'-buthylidene bis(6-tert-butyl-2-methylphenol), 1,1,3-tris(2-methyl-4-hydroxy-5-cyclohexylphenyl)butane, 4,4'-thiobis(6-tert-butyl-2-methylphenol), 4,4'-diphenol sulfone, 4-isopropoxy-4'-hydroxydiphenyl sulfone, 4-benzyloxy-4'- hydroxydiphenyl sulfone, 4,4'-diphenol sulfoxide, isopropyl p-hydroxybenzoate, benzyl p-hydroxybenzoate, benzyl protocatechuate, stearyl gallate, lauryl gallate, octyl gallate, 1,3-bis(4-hydrobyphenylthio)propane, N,N'-diphenylthiourea, N,N'-di(m-chlorophenyl)thiourea, salicyl anilide, methyl bis(4-hydroxyphenyl)acetate, benzyl bis(4-hydroxyphenyl)acetate, 1,3-bis(4-hydroxyphenyl)benzene, 1,4-bis(4-hydroxyphenyl)benzene, 2,4'-diphenol sulfone, 3,3'-diallyl-4,4'-hydroxyphenyl sulfone, 3,4-dihyroxy-4'-methyldiphenyl sulfone, zinc 1-acetyloxy-2-naphthoate, zinc 2-acetyloxy-3-naphthoate, zinc 2-acetyloxy-1-naphthoate, α, α-bis(4-hydroxyphenyl)-α-methyl toluene, a complex of zinc thiocyanate with antipyrine, tetrabromo bisphenol A, tetrabromo bisphenol S, 4,4'-thiobis(2-methylphenol), and 4,4'-thiobis(2-chlorophenol).

The leuco dyes conventionally used in the thermosensitive recording materials are usable in this invention. Its mixture is also usable. The leuco compounds of the dyes such as triphenylmethane phihalide, trially methane, fluoran, phenotriazine, tiofluoran, xanthene, indophthalyl, spiropyran, azaphthalide, chromenopyrazole, methine, Rhodamine anilinolactam, Rhodamine lactam, quinazoline, diazaxanthene and bislactone dyes are preferable. Usable leuco dyes include, but not limited to, 3,3-bis(p-dimethylaminophenyl)phthalide, 3,3-bis(p-dimethylaminophenyl)-6-dimethylaminophthalide, 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluoran, 3-dimethylamino-5,7-dimethylfluoran, 3-(N-methyl-N-isoamylamino)-6-methyl-7-anilinofluoran, 3-(N-methyl-N-isobutylamino)-6-methyl-7-anilinofluoran, 3-(N-p-tolyl-N-ethylamino)-6-methyl-7-anilinofluoran, 3-(N-methyl-N-amylamino)-6-methyl-7-anilinofluoran, 3-(N,N-di-n-amylamino)-6-methyl-7-anilinofluoran, 3-(N-methyl-N-cyclohexylamino)-6-methyl-7-anilinofluoran, 3-(N-methyl-N-isopropylamino)-6-methyl-7-anilinofluoran, 3-(N-ethyl-N-isopropylamino)-6-methyl-7-anilinofluoran, 3-(N-ethyl-N-tetrahydrofurfurylamino)-6-methyl-7-anilinofluoran, 3-dimethylamino-7,8-benzofluoran, 3-diethylamino-7-chlorofluoran, 3-diethylamino-7-methylfluoran, 3-diethylamino-6-methyl-7-chlorofluoran, 3-pyrrolidino-6-methyl-7-anilinofluoran, 3-diethylamino-6-methyl-7-(m-trichloroanilino)fluoran, 3-diethylamino-7-(o-chloroanilino)fluoran, 3-dibutylamino-7-(o-chloroanilino)fluoran, 3-diethylamino-6-methyl-7-anilinofluoran, 3-dibutylamino-6-methyl-7-anilinofluoran, 3-diethylamino-6-methyl-7-(2',4'-dimethylanilino)fluoran, 3-(N,N-diethylamino)-5-methyl-7-(N,N-dibenzylamino)fluoran, benzoyl leucomethylene blue, 6'-chloro-8'-methoxybenzoylindolinospiropyran, 6'-bromo-8'-methoxybenzoylindolinospiropyran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3'-(2'-hydroxy-4'-diethylaminophenyl)-3-(2'-methoxy-5'-methylphenyl)phthalide, 3'-(2'-methoxy-4'-dimethylaminophenyl)-3-(2'-hydroxy-4'-chloro-5'-methylphenyl)phthalide, 3-morpholino-7-(N-propyltrifluoromethylanilino)fluoran, 3-pyrrolidino-7-trifluoromethylanilino-fluoran, 3-diethylamino-5-chloro-7-(N-benzyl-trifluoromethylanilino) fluoran, 3-pyrrolidino-7-(di-p-chlorophenyl)methylaminofluoran, 3-diethylamino-5-chloro-7-(α-phenylethylamino)fluoran, 3-(N-ethyl-N-p-toluidino)-7-(α-phenylethylamino)fluoran, 3-diethylamino-7-(o-methoxycarbonylphenylethyl)fluoran, 3-diethylamino-5-methyl-7-(α-phenylethylamino)fluoran, 3-diethylamino-7-piperidinoaminofluoran, 2-chloro-3-(N-methyltoluidino)-7-(p-N-butylanilino)fluoran, 3,6-bis(dimethylamino)fluorenespiro(9,3')-6'-dimethylaminophthalide, 3-(N-ethyl-N-cyclohexylamino)-5,6-benzo-7-α-naphthylamino)-4'-bromofluoran, 3-diethylamino-6-chloro-7-anilinofluoran, 3-(N-ethyl-N-2-ethoxypropylamino)-6-methyl-7-anilinofluoran, 3-(N-ethyl-N-tetrafurfurylamino)-6-methyl-7-anilinofluoran, 3-diethylamino-6-methyl-7-mesidino)-4',5'-benzofuran, 3-(p-dimetylaminophenyl)-3-{1,1-bis(p-dimethylaminophenyl)ethylene-2-yl}phthalide, 3-(p-dimethylaminophenyl)-3-{1,1-bis(p-dimethylaminophenyl)ethylene-2-yl}-6-dimethylamiophthalide, 3-(p-dimethylaminophenyl)-3-(1-p-dimethylaminophenyl)-1-phenylethylene-2-yl)phthalide, 3-(p-dimethylaminophenyl)-3-(1-p-dimethylaminophenyl-1-p-chlorophenylethylene-2-yl)-6-dimethylaminophthalide, 3-(4'-dimethylamino-2'-methoxy)-3-(1"-p-dimethylaminophenyl-1"-p-chlorophenyl-1",3"-butadiene-4"-yl)benzophtahlide, 3-(4'-dimethylamino-2'-benzyloxy)-3-(1"-p-dimethylaminophenyl-1"-phenyl-1",3"-butadiene-4"-yl)benzophthalide, 3-dimethylamino-6-dimethylamino-fluorene-9-spiro-3'-(6'-dimethylamino)phthalide, 3,3-bis{2-(p-dimethylaminophenyl)-2-(p-methoxyphenyl)ethenyl}-4,5,6,7-tetrachlorophthalide, 3-bis{1,1-bis(4-pyrrolidinophenyl)ethylene-2-yl}-5,6-dichloro-4,7-dibromophthalide, bis(p-dimethylaminostyryl)-1-naphthalene sulfonylmethane, and bis(p-dimethylaminostyryl)-1-p-tolylsulfonylmethane.

In addition to the color developer and the leuco dye, the thermosensitive color developing layer of this invention may contain a thermoplastic substance as a sensitivity improver. Usable thermoplastic materials include, but not limited to, fatty acids such as stearic acid and behenic acid, fatty acid amides such as stearic acid amide and palmitic acid amide, metal salts of fatty acids such as zinc stearate, aluminum stearate, calcium stearate, zinc palmitate and zinc behenate, p-benzyl biphenyl or terphenyl, triphenyl methane, benzyl p-benzyloxybenzoate, β-benzyloxy naphthalene, phenyl β-naphtoate, phenyl 1-hydroxy-2-naphthoate, methyl 1-hydroxy-2-naphthoate, diphenyl carbonate, guaiacol carbonate, dibenzyl terephthalate, dimethyl terephthalate, 1,4-dimethoxy naphthalene, 1,4-diethoxy naphthalene, 1,4-dibenzyloxy naphthalene, 1,2-diphenoxy ethane, 1,2-bis(3-methylphenoxy)ethane, 1,2-bis(4-methylphenoxy)ethane, 1,4 -diphenoxy butane, 1,4-diphenoxy-2-butene, 1,2-bis(4-methoxyphenylthio)ethane, dibenzoyl methane, 1,4-diphenyl thiobutane, 1,4-diphenyl thio-2-butene, 1,3-bis(2-vinyloxyethoxy)benzene, 1,4-bis(2-vinyloxyethoxy)benzene, p-(2-vinyloxyethoxy)biphenyl, p-aryloxy biphenyl, p-propargyloxy biphenyl, dibenzoyloxy methane, dibenzoyloxy propane, dibenzyl disulfide, 1,1-diphenyl ethanol, 1,1-diphenyl propanol, p-benzyloxy benzylalcohol, 1,3-phenoxy-2-propanol, N-octadecyl carbamoyl-p-methoxycarbonyl benzene, N-octadecylcarbamoyl benzene, 1,2-bis(4-methoxyphenoxy)propane, 1,5-bis(4-methoxyphenoxy)-3-oxapenetane, dibenzyl oxalate, bis(4-methylbenzyl) oxalate, bis(4-chlorobenzyl) oxalate.

If necessary, any conventional additives such as a filler, a surfactant, a lubricant and an agent for preventing the color development via pressure may be incorporated. The fillers include inorganic fine powders such as zinc oxide, titanium oxide, zinc hydroxide, barium sulphate and surface-treated silica, and organic fine powders such as urea-formalin resin, styrene-methacrylic acid copolymer, polystyrene resin and vinylidene chloride resin. The lubricants include higher fatty acids and their salts, higher fatty acid amides, higher fatty acid esters and various waxes of animal, plant, mineral or petroleum sources.

In order to prepare the thermosensitive color developing layer, any known binder can be used. Usable binders include, but not limited to, water-soluble polymers including polyvinyl alcohol, starch or its derivatives, cellulose derivatives including methoxycellulose, hydroxyethyl cellulose, carboxymethyl cellulose, methyl cellulose and ethyl cellulose, sodium polyacrylate, polyvinyl pyrrolidone, acrylamide/acrylate ester copolymer, acrylamide/acrylate ester/methacrylic acid terpolymer, alkaline salt of styrene/maleic anhydride copolymer, alkaline salt of isobutylene/maleic anhydride copolymer, polyacrylamide, sodium alginate, gelatin and casein, emulsions of polyvinyl acetate, polyurethane, polyacrylate ester, polymethacrylate ester, vinyl chloride/vinyl acetate copolymer and ethylene/vinyl acetate, and latex of styrene/butadiene/acrylic copolymer.

The provision of the protective layer mainly composed of polyvinyl alcohol together with either aziridine compound or dimethylolurea on the thermosensitive color developing layer is essential in this invention. Usable aziridine compounds include, but not limited to, N, N'-hexamethylene-1, 6-bis(1-aziridinecarbamide), N, N'-diphenylmethane-4,4'-bis(1-aziridinecarbamide), trimethylolpropane-tri-β-aziridinylpropionate, and tetramethylolmethane-tri-β-(2-methylaziridine)propionate. 2,4-Diethyleneureide toluene is particularly preferred.

The total amount of (polyvinyl alcohol+aziridine compound) or (polyvinyl alcohol+dimethylolurea) is 0.01 to 1.0, preferably 0.03 to 0.5, part by weight.

EXAMPLE

The following examples will more fully illustrate the embodiments of the invention. All parts and percentages referred to therein are by weight.

Example 1

Twenty parts of 3-N,N-dibutylamino-6-methyl-7-anilinofluoran, 20 parts of 10% polyvinyl alcohol aqueous solution and 60 parts of water were dispersed using a glass ball in a glass mayonnaise bottle for 2 days to prepare "A" liquid. Similarly, 20 parts of 4-(β-phenoxyethoxy)phthalic acid, 20 parts of 10% polyvinyl alcohol aqueous solution and 60 parts of water were dispersed using the glass ball in the glass mayonnaise bottle for 2 days to prepare "B" liquid.

Next, 10 parts of the "A" liquid was mixed with 30 parts of the "B" liquid to prepare a liquid for the preparation of the thermosensitive color developing layer. This liquid was coated in an amount so that the dye was contained in an amount of 0.5 g/m$^2$ after drying on the surface of a commercially available pure paper (weighting: 52 g/m$^2$), thereby a thermosensitive color developing layer was provided on the paper.

Next, 10 parts of 2,4-diethyleneureide toluene and 90 parts of water were dispersed using the glass ball in the glass mayonnaise bottle for 2 hours to prepare "C" liquid. Five parts of the "C" liquid and 10 parts of 10% polyvinyl alcohol aqueous solution were mixed to prepare a liquid for the preparation of the protective layer. This liquid was coated in an amount so that the dye was contained in an amount of 3.5 g/m$^2$ after drying on the thermosensitive color developing layer, thereby the protective layer was provided thereon.

Subsequently, the surface of the protective layer was calendered so that its smoothness was 500 to 600 seconds, thereby a thermosensitive recording material was prepared.

Example 2

Twenty parts of silicon dioxide and 80 parts of water were dispersed using the glass ball in the glass mayonnaise bottle for 2 days to prepare "D" liquid. Ten parts of the "A" liquid, 30 parts of the "B" liquid, 10 parts of "D" liquid and 10 parts of a dispersion of zinc stearate (concentration: 30%) were mixed to prepare a liquid for the preparation of the thermosensitive color developing layer. Using this liquid, a thermosensitive color developing layer was provided on the paper according to the procedure as described in Example 1.

Five parts of the "C" liquid, 5 parts of "D" liquid, 10 parts of 10% polyvinyl alcohol aqueous solution and 0.3 part of a dispersion of zinc stearate (concentration: 30%) were mixed to prepare a liquid for the preparation of the protective layer. using this liquid, a protective layer was provided on the thermosensitive color developing layer according to the procedure as described in Example 1, thereby a thermosensitive recording material was prepared.

Example 3

Twenty parts of 4-(4'-phenoxybutoxy)phthalic acid, 20 parts of 10% polyvinyl alcohol aqueous solution and 60 parts of water were mixed to prepare "E" solution. Using the "E" solution in place of the "B" solution, a thermosensitive recording material was prepared according to the procedure as described in Example 2.

Example 4

Three parts of 10% dimethylolurea aqueous solution and 1.2 part of 1% ammonium tartarate aqueous solution were mixed to prepare "C'" liquid. Using the "C'" liquid in place of the "C" liquid, a thermosensitive recording material was prepare according to the procedure as described in Example 2.

Example 5

20 parts of aluminium hydroxide and 80 parts of water were mixed to prepare "F" liquid. Using the "F" liquid in place of the "D" liquid, a thermosensitive material was prepared according to the procedure as described in Example 2.

Example 6

Twenty parts of talc and 80 parts of water were mixed to prepare "G" liquid. Using the "G" liquid in place of the "D" liquid, a thermosensitive recording material was prepared according to the procedure as described in Example 2.

Example 7

Twenty parts of kaolin and 80 parts of water were mixed to prepare "H" liquid. Using the "H" liquid in place of the "D" liquid, a thermosensitive recording material was prepared according to the procedure as described in Example 2.

Comparative Example 1

Using 1.25 part of 25% polyamide-epichlorohydrin resin aqueous solution in place of the "C" liquid, a thermosensitive recording material was prepared according to the procedure as described in Example 2.

Comparative Example 2

Twenty parts of 4-hydroxy-4'-isopropoxydiphenyl sulfone, 20 parts of 10% polyvinyl alcohol aqueous solution and 60 parts of water were mixed to prepare "I" liquid. Using the "I" liquid in place of the "B" liquid, a thermosensitive recording material was prepared according to the procedure as described in Example 2.

After the thermosensitive recording materials prepared in the above examples and comparative examples were stored under conditions of 40° C. and 30% RH for 16 hours, a thermal block of 150° C. was applied thereto under a load of 2 kg/cm$^2$ for 1 second. The resultant printed samples were tested with respect to water-, oil- and plasticizer-resistances as follows:

water-resistance test:

After each sample was immersed in a tap water for 16 hours, densities of its background and colored regions were determined.

oil-resistance test:

After the surface of each sample was coated with a cotton seed oil (reagent grade, manufactured by Kanto Kagaku) and stored at 40° C. under dry condition for 16 hours or 7 days, densities of its background and colored regions were determined.

plasticizer-resistance test:

Three wrap films comprising vinyl chloride were overlaid on the surface of each sample. After the thus-overlaid material was stored with a load of 5 kg at 40° C. under dry condition for 16 hours or 7 days, densities of its background and colored regions were determined.

For the determination of the densities of the background and colored regions, Macbeth densitometer Model RD-914 was used.

The results are shown in the following table.

| | before test | | water-resistance | | oil-resistance (16 h) | | plasticizer-resistance (16 h) | | oil-resistance (7 d) | | plasticizer-resistance (7 d) | |
|---|---|---|---|---|---|---|---|---|---|---|---|---|
| | colored regions | back-ground regions | colored regions | back-ground regions | colored regions | back-ground regions | colored regions | back-ground regions | colored regions | back-ground regions | colored regions | back-ground regions |
| Ex. 1 | 1.52 | 0.09 | 1.50 | 0.08 | 1.51 | 0.09 | 1.49 | 0.09 | 1.47 | 0.09 | 1.51 | 0.09 |
| Ex. 2 | 1.35 | 0.09 | 1.22 | 0.08 | 1.33 | 0.09 | 1.30 | 0.09 | 1.32 | 0.09 | 1.32 | 0.09 |
| Ex. 3 | 1.33 | 0.09 | 1.21 | 0.08 | 1.32 | 0.09 | 1.33 | 0.09 | 1.30 | 0.09 | 1.31 | 0.09 |
| Ex. 4 | 1.33 | 0.09 | 1.19 | 0.08 | 1.32 | 0.09 | 1.30 | 0.09 | 1.31 | 0.09 | 1.33 | 0.09 |
| Ex. 5 | 1.34 | 0.09 | 1.19 | 0.08 | 1.33 | 0.09 | 1.34 | 0.09 | 1.31 | 0.09 | 1.32 | 0.09 |
| Ex. 6 | 1.31 | 0.09 | 1.18 | 0.08 | 1.34 | 0.09 | 1.33 | 0.09 | 1.31 | 0.09 | 1.33 | 0.09 |
| Ex. 7 | 1.32 | 0.09 | 1.16 | 0.08 | 1.32 | 0.09 | 1.33 | 0.09 | 1.30 | 0.09 | 1.30 | 0.09 |
| Comp. Ex. 1 | 1.33 | 0.09 | 0.30 | 0.08 | 1.33 | 0.09 | 1.33 | 0.09 | 1.30 | 0.09 | 1.32 | 0.09 |
| Comp. Ex. 2 | 1.35 | 0.09 | 1.18 | 0.09 | 1.29 | 0.08 | 1.26 | 0.10 | 0.72 | 0.11 | 0.66 | 0.10 |

As clear from the results in the above table, the thermosensitive recording material of this invention is excellent in recording density and long storage stability of the recorded images.

Further, the above thermosenstive recording material was tested by printing in a thermal printer having a thermal head of 8 dots/mm (manufactured by Okura Denki). The thermosensitive material of Example 1 showed the color development at higher density, but a sticking phenomenon was observed in the colored regions. Other thermoplastic materials of this invention showed good results.

Effect of the Invention

According to the thermosensitive recording material of this invention, at least one of the phthalic acid derivatives represented by the general formula (I) is used as the color developer in the thermosensitive color developing layer and the protective layer mainly composed of polyvinyl alcohol together with either aziridine compound or dimethylolurea is provided on the thermosensitive color developing layer, thereby the thermosensitive recording material of this invention is excellent in sensitivity and density of the color development and has the high storage stability of the recorded images. Accoringly, the thermosensitive recording material of this invention is very useful.

When the selected inorganic filler is incorporated in the thermosensitive color developing layer and/or the protective layer, the thermosensitive recording material of this invention is excellent in matchability with the thermal head.

We claim:

1. A thermosensitive recording material having a support, on which a thermosensitive color developing layer mainly composed of a leuco dye and a color developer which is contacted with the leuco dye while heating to develop a color and a protective layer mainly composed of polyvinyl alcohol together with either aziridine compound or dimethylolurea are successively provided, the color developer being at least one of phthalic acid derivatives represented by the following general formula (I):

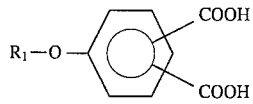

(I)

wherein $R_1$ is a straight or branched, saturated or unsaturated hydrocarbon group, a straight hydrocarbon group which may have a hydroxy group or a ether or carbonyl linkage, an aryl group which may be substituted,

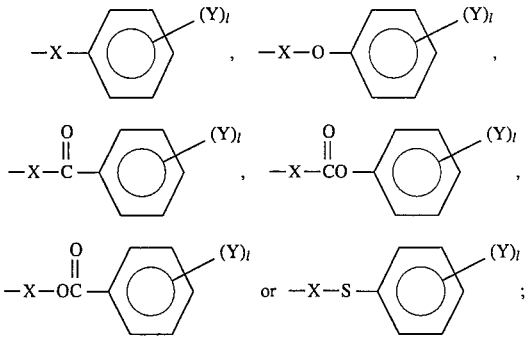

X is a saturated or unsaturated bivalent hydrocarbon group;

Y is a lower alkyl or alkoxy group, a nitro group or a halogen atom; and l is 0 to 5.

2. A thermosensitive recording material as defined in claim 1, wherein at least one inorganic filler selected from silicon dioxide, aluminum hydroxide, talc and kaolin is incorporated in the thermosensitive color developing layer and/or the protective layer.

* * * * *

UNITED STATES PATENT AND TRADEMARK OFFICE

CERTIFICATE OF CORRECTION

PATENT NO. : 5,622,909

DATED : April 22, 1997

INVENTOR(S) : Hiromi FURUYA, et al.

It is certified that error appears in the above-indentified patent and that said Letters Patent is hereby corrected as shown below:

On the title page, Item [75], the inventors, should read:

--Hiromi Furuya, Shimizu-machi; Keishi Taniguchi, Susono; Hideo Suzaki, Numazu; Kunio Hayakawa, Gotenba, all of Japan--

Signed and Sealed this

Twelfth Day of August, 1997

Bruce Lehman

*Attest:*

BRUCE LEHMAN

*Attesting Officer*

*Commissioner of Patents and Trademarks*